US006364062B1

(12) United States Patent
Ericson et al.

(10) Patent No.: US 6,364,062 B1
(45) **Date of Patent: *Apr. 2, 2002**

(54) LINEAR TRACKING MECHANISM FOR ELEVATOR ROPE

(75) Inventors: Richard J. Ericson, Southington; John T. Pitts, Avon; John P. Wesson, Vernon, all of CT (US)

(73) Assignee: Otis Elevator Company, Farmington, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/435,506

(22) Filed: Nov. 8, 1999

(51) Int. Cl.[7] ..... B66B 7/06

(52) U.S. Cl. ..... 187/264; 187/414; 254/389; 242/615.3

(58) Field of Search ..... 187/411, 251, 187/252, 253, 254, 256, 262, 264, 265, 266, 407, 414; 254/389; 242/615.3

(56) References Cited

U.S. PATENT DOCUMENTS

| | | | | | |
|---|---|---|---|---|---|
| 2,074,045 | A | * | 3/1937 | Carpenter | 254/389 X |
| 2,228,042 | A | * | 1/1941 | Zanger | 254/389 X |
| 2,387,520 | A | * | 10/1945 | Lindabury | 254/389 |
| 2,625,373 | A | * | 1/1953 | Hunt | 254/333 |
| 3,666,051 | A | * | 5/1972 | Davis et al. | 187/251 X |
| 3,882,968 | A | * | 5/1975 | Suozzo | 187/264 |
| 4,145,920 | A | * | 3/1979 | Yamagami | 187/266 X |
| 4,620,615 | A | * | 11/1986 | Morris et al. | 187/264 |
| 4,651,974 | A | * | 3/1987 | Frommherz | 254/294 |
| 5,186,283 | A | * | 2/1993 | Salmon | 187/254 |
| 5,791,011 | A | * | 8/1998 | Richter et al. | 187/414 X |
| 5,921,352 | A | * | 7/1999 | Garrido et al. | 187/264 |
| 5,941,674 | A | * | 8/1999 | Briehl | 242/615.3 X |
| 6,047,873 | A | * | 4/2000 | Carlberg et al. | 242/615.3 |
| 6,138,799 | A | * | 10/2000 | Schroder-Brumloop et al. | 187/252 |

FOREIGN PATENT DOCUMENTS

| | | | | |
|---|---|---|---|---|
| DE | 2136540 | A * | 2/1973 | 187/411 |
| EP | 0 346 160 | | 12/1989 | B66B/7/06 |
| JP | 6-321457 | | 11/1994 | B66B/7/06 |
| SU | 700414 | A * | 11/1979 | 187/264 |
| SU | 1533978 | A * | 1/1990 | 187/411 |

* cited by examiner

*Primary Examiner*—Eileen D. Lillis
*Assistant Examiner*—Thuy V. Tran

(57) ABSTRACT

An elevator guide system for flat rope tracking prevents the flat rope from hitting the shoulders on a rotating sheave to prevent premature degradation emitting objectionable sounds. The rope guide system includes one or more guide bodies having channels generally aligned with sheave grooves to which each block is adjacently positioned using a frame-mount. The guide bodies align the flat belt on entry into and exit from a sheave. The guide bodies may have a planar back surface, or a circular back surface, with the channel sidewalls disposed thereon and extending outwardly at right angles therefrom.

11 Claims, 2 Drawing Sheets

LINEAR TRACKING MECHANISM FOR ELEVATOR ROPE

TECHNICAL FIELD

The present invention relates to elevator systems and, more particularly, to a belt guide system to provide tracking for flexible, flat elevator ropes.

BACKGROUND OF THE INVENTION

Flexible, flat elevator ropes are used in certain elevator systems because they provide several advantages over conventional, round ropes such as high traction and low profile. Flat elevator ropes have certain drawbacks, however, including a tendency to have poor tracking during operation. If a flat rope does not track properly, noise is generated by the a misaligned rope that is objectionable to passengers. Under severe misalignment conditions, the edges of the flat rope are susceptible to damage and may require premature replacement.

OBJECTS AND SUMMARY OF THE INVENTION

It is an object of the present invention to provide a flat rope guide device for elevator systems that provides improved rope tracking and minimizes or prohibits misalignment.

It is a further object of the present invention to provide a rope guide device that minimizes or removes excessive noise or wear on flat ropes in elevator systems.

It is a further object of the present invention to provide a rope guide device for elevator systems that makes the flexible, flat rope more forgiving to sheave misalignment and rope twist associated with particular hoistway and elevator system configurations.

These and other objects are achieved by the present invention described herein.

One embodiment of the present invention is directed to an elevator guide system for rope tracking. Although the present invention may be implemented for use with various types of elevator ropes including round ropes, the preferred embodiments are described with respect to flat ropes. In addition, it should be noted that the present invention may be utilized with either traction sheaves or with idler sheaves, and may be mounted on the car, the counterweight, or the machine in a position proximate to the sheaves. The linear guidance system prevents the flat rope from hitting the shoulders on a rotating sheave, and thereby prevent the rope from prematurely degrading or emitting objectionable sounds. The system is integrated into the car and counterweight sheave in such a way as to be easily adjustable and serviceable.

The elevator rope guide system according to the present invention comprises one or more guide block bodies having one or more channels generally aligned with sheave grooves to which each block is adjacently positioned using a frame-mount. The guide blocks align the flat belt on entry into and exit from a sheave.

A second preferred embodiment is directed to the use of one or more guide roller assemblies, instead of guide blocks, wherein each roller assembly has one or more channels, each formed by a rotatable ring-shaped members mounted for rotation about an axle. A set of flanges may be used to separate each roller, each thereby forming a wall or shoulder.

It should be noted that through the implementation of either embodiment it is possible to use a sheave in combination with the present invention wherein the sheave has no need for grooves or shoulders formed by flanges to guide the belt around the sheave. One advantage of such a system is that the wear on a belt or belt jacket normally associated with such flanges or shoulders is eliminated.

DESCRIPTION OF THE PREFERRED EMBODIMENTS

An elevator rope guide system according to the present invention comprises one or more elevator rope guide devices of which the preferred embodiment is now described.

Figure 1:
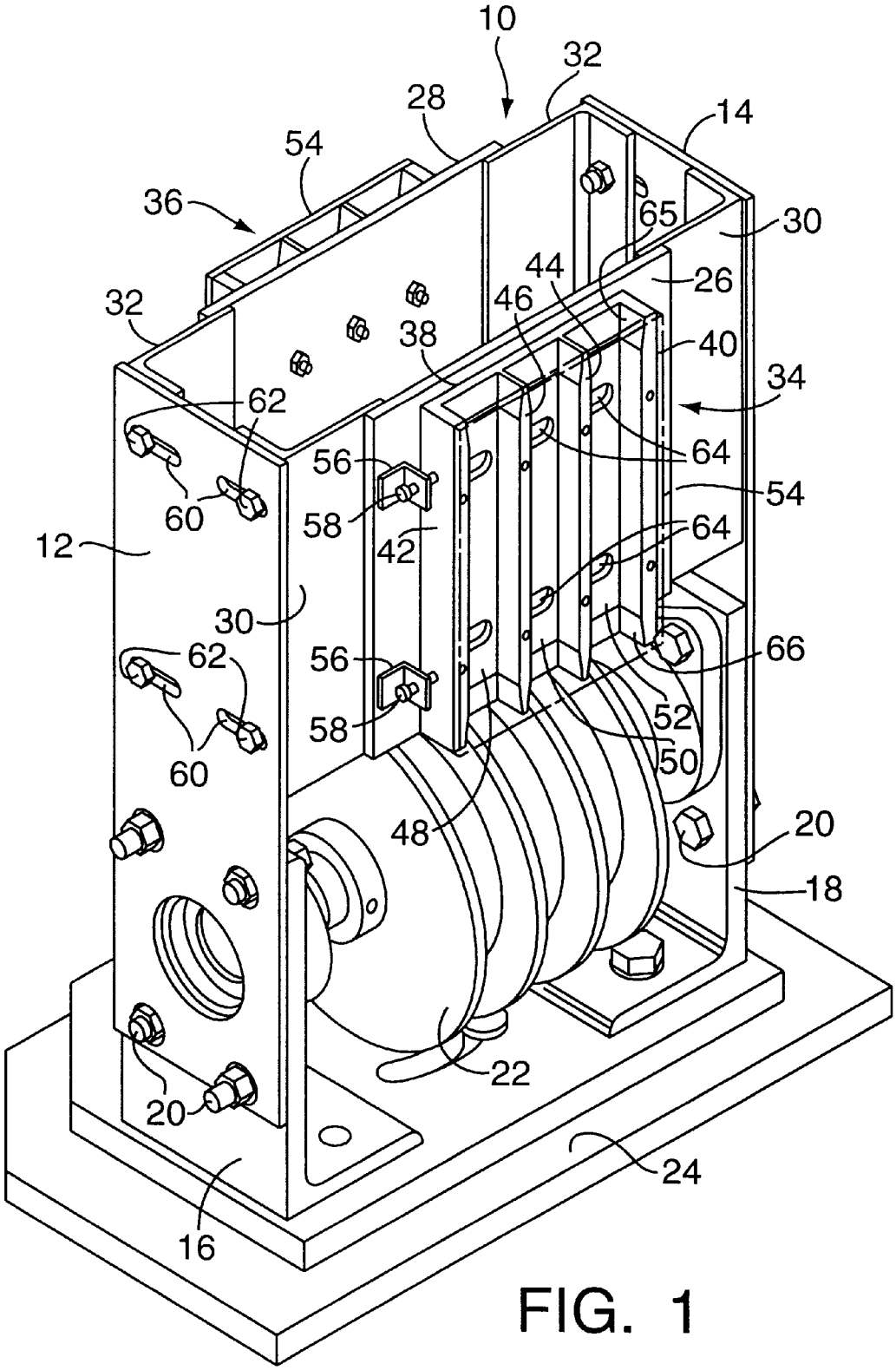
FIG. 1 is a schematic, orthogonal view of a first preferred embodiment of an apparatus according to the present invention rope guide system.

Referring to FIG. 1, an elevator rope guide device (10) according to the first exemplary embodiment of the present invention includes a frame comprising a set of side brackets (12, 14) that are adapted to be mounted by means of bolts (20) or similar means to the base brackets (16, 18) of an elevator sheave mount that holds a sheave (22) relative to a surface (24) such as a hoistway surface. The frame of the guide device (10) includes a pair of cross-brackets (26, 28) that, together with corner sections (30, 32), span across the side brackets (12, 14) in a parallel relationship. Each cross-bracket (26, 28) is adapted to hold a guide block (34, 36) so that one is generally tangentially aligned with each of two sides of the sheave (22) as shown in FIG. 1.

Each guide block (34, 36) comprises back wall (38) and two sidewalls (40, 42). A plurality of channel walls (44, 46) are provided in between the sidewalls and generally parallel therewith to form a plurality of guide slots (48, 50, 52). The back wall (38), sidewalls (40, 42) and channel walls (44, 46) provide engagement surfaces which provide alignment of an elevator flat rope, i.e., belt (best shown hereinafter in FIG. 2) sized for operative engagement with the guide blocks (34, 36) and sheave (22). Ideally, the rope is aligned with the guide block to make as little contact with the back wall (38) as possible, and most of the forces exerted for alignment control come from the sidewalls (40, 42) and channel walls (44, 46). The intention, in general, is that the rope touches the side and channel walls only in order to reduce wear and tear on the rope.

Each guide block (34, 36) may also be provided with a removable front wall (54). The front wall (54) may be transparent to allow viewing of elevator ropes beneath the wall (54) to inspect for wear. Each guide block (34, 36) is mounted to a respective cross-bracket (26, 28) using angle brackets (56) and set screws (58) to facilitate position adjustment relative to the cross-bracket (26, 28) in a direction generally parallel thereto. Adjustment in a direction generally perpendicular to the cross-brackets (26, 28) is facilitated by slots (60) and bolts (62) connecting the corner sections (30,32) to the side brackets (12, 14).

Although the guide blocks (34,36) are shown in this exemplary embodiment as single guide blocks with a plurality of guide slots (48, 50, 52), it will be clear to one skilled in the art that there may be only a single guide slot per guide block. Alternatively, there may be a plurality of independent guide blocks per guide device (10) or any combination thereof. Moreover, the guide blocks may be instrumented with sensing devices, e.g., springs, strain gages or temperature sensors, to remotely monitor significant parameters of the belts and/or their alignment relative to the sheave. Additionally, control devices may also be employed on the guide blocks, for example, springs could be used to control the correcting forces applied to the belts, such that wear of the belts is minimized.

Figure 2:
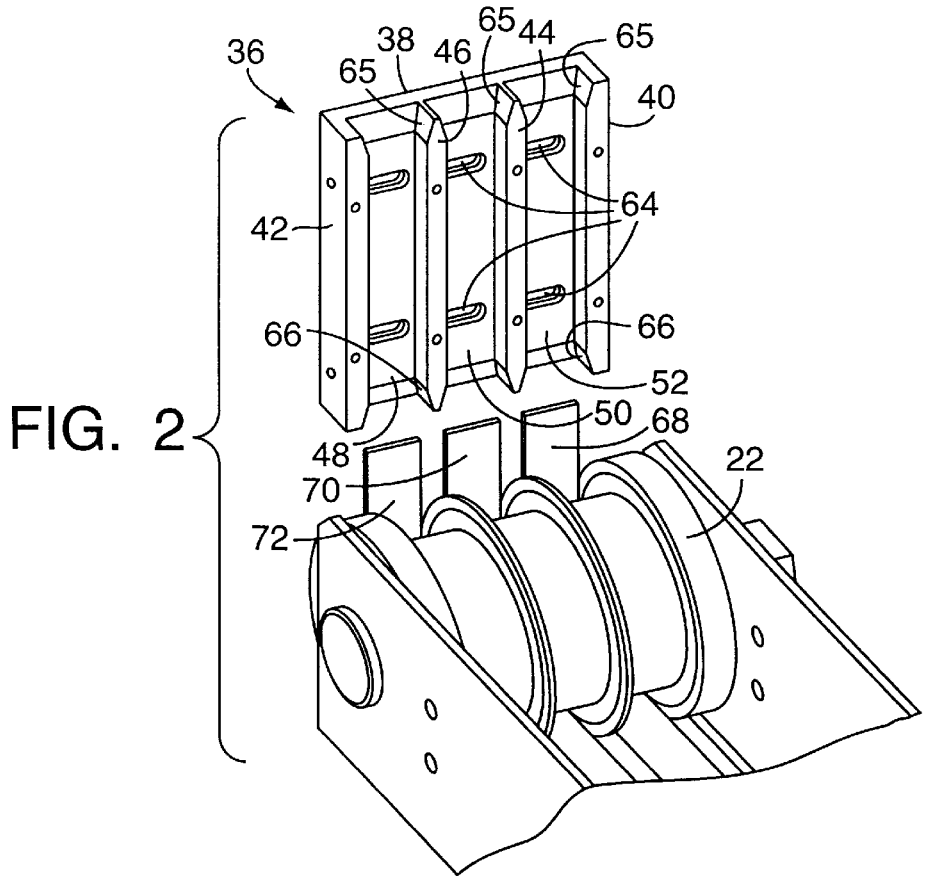
FIG. 2 is a partial, schematic, orthogonal view of the first preferred embodiment of an apparatus according to the present invention rope guide system.

Referring to FIG. 2, the features of each of the guide blocks (36, 38) are described with respect to one guide block (36). The guide block (36) includes lateral recessed slots (64) in each of the guide slots (48, 50, 52) to facilitate mounting and lateral adjustment relative to the cross-bracket (28). This arrangement enables convenient and fast access for servicing.

At each end of a guide slot (48, 50, 52) the edges (64, 66) are beveled or sloped to more smoothly guide a flat rope (68) into or out of (depending on sheave rotation direction) the guide slot (48, 50, 52) by limiting the stress gradient of the belt. The guide slots (48, 50, 52) are configured to be wider than the flat ropes (68, 70, 72) and narrower than grooves on the sheave to avoid noise generation, wear, and premature belt degradation.

The guide slots (48, 50, 52) and other parts of each guide block may be made from a low-friction material with a sufficient pressure-velocity (PV) rating such that belt wear rates will be very low with a lateral belt restoring force of approximately one to fifteen pounds, in the preferred embodiment. Selection of the low-friction material, e.g., Teflon®, Delrin®, Nylon® or Ultra High Molecular Weight Polyethylene (UHMWP), for the guide block surfaces which engage the belt will depend upon the material of the belt itself. For such a rating, as mentioned above, a material such as DELRIN® 100AF used with a linear guide block having a length of 100mm–350 mm long may be used. Using a guide block having an length of about 210 mm, it has been found that using a space between the block and the sheave of about 200 mmn, it is easier to steer a belt into a belt groove with a low corrective force (usually 20N or less).

The closer the guide blocks (34, 35) are to the sheave (22), the greater the control of the alignment of the belt relative to the sheave, but the more force required to exercise the control. Conversely, the further away the guide blocks are located, the less force required to exert control, but the less alignment control there is available. Optimally, the guide block should be spaced a predetermined distance away from the sheave to apply minimal guidance force on the belt, while maintaining reasonable alignment control.

Moreover, optimal control of the guide device (10) on the belt alignment can result in the elimination of the grooves or flanges on the sheaves traditionally used to hold the belt in place. Since the sheaves would require only a generally circular surface having a substantially constant radius to operatively engage the belt, they would be significantly easier to machine. This would result in a simpler design of the sheaves and a significant reduction in cost. This is especially so in the case of traction sheaves, i.e., sheaves that are directly coupled to, or are an integral part of, the elevator motor drive shaft.

Through the use of the mounting and adjustment arrangement described above, the guide block (36) can be easily adjusted in directions parallel and perpendicular to the plane of the cross-bracket (26, 28) to which it is mounted, as well as rotationally about an axis perpendicular to the plane of the cross-brackets. In operation, one or more guide devices (10) according to the present invention are installed adjacent to corresponding sheaves to guide flat ropes in an elevator system.

Figure 3:
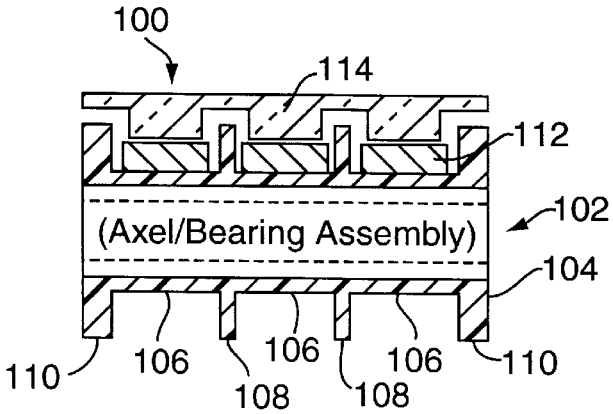
FIG. 3 is a partial, schematic, front, cross-sectional view of a second preferred embodiment of the present invention.
Figure 4:
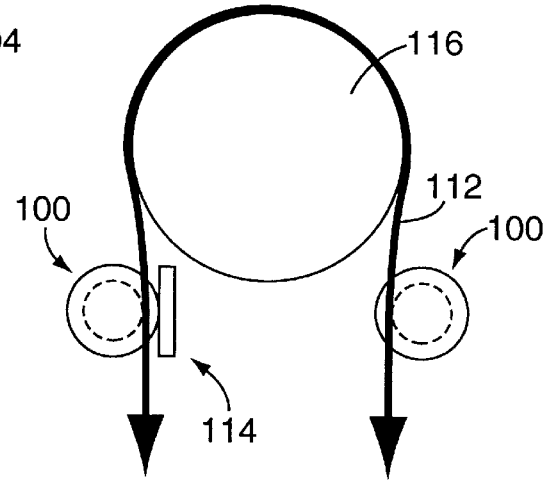
FIG. 4 is a partial, schematic, side, cross-sectional view of the second preferred embodiment of the present invention.

In a second preferred embodiment, illustrated in FIGS. 3–4, a guide roller (100) according to the present invention includes a bearing assembly (102) and a rotatably mounted guide body (104). The guide body (104) may have a plurality of distinct grooves (106) formed by middle flanges (108) and end flanges (110), as shown. Alternatively, the guide device (10) may include a plurality of independent guide bodies rotatably mounted on the same axis. A rope or flat belt (112), as shown, may be received in each groove (106). An optional retaining plate (114) may be provided to prevent inadvertent displacement of the belt (112) from a groove (106). As illustrated in FIG. 4, one or more guide rollers (100) according to the present invention may be positioned adjacent to a sheave (116) around which a belt (112) is positioned. The belt (112) engages the guide rollers (100) in the manner described with respect to FIG. 3.

The grooves (106) and other parts of each guide roller (100), particularly those parts that contact a rope or belt, may be made from a low-friction material with a sufficient pressure-velocity (PV) rating such that belt wear rates will be very low. In a manner similar to that described above with respect to the first embodiment, the guide roller (100) is mounted in a manner to be easily adjusted with respect to the sheave (116).

Although the exemplary embodiments have shown the engagement surfaces aligning the belt as being part of the sides and bottom surfaces of planar guide slots (48, 50, 52) or circular guide grooves (106), other configurations are within the scope of this invention. For example, the engagement surfaces may include the grooves in rotating discs disposed on either side of the belts. Alternatively, a channel or groove may be cut into the belt itself so that the belt may ride over a single guiding engagement surface.

While the preferred embodiments have been described herein, it is understood that variation and modification may be made without departing from the scope of the presently claimed invention.

What is claimed is:

1. An elevator system comprising:

an elevator car engaged with an elevator rope;

an elevator sheave in operative engagement with the elevator rope; and an elevator rope guide device including a guide body in operative engagement with the elevator rope, the guide body including an opposed pair of generally planar engagement surfaces adapted to receive the elevator rope therebetween, the engagement surfaces adapted to engage opposing portions of the elevator rope there-against, wherein the pair of engagement surfaces enables the guide body to provide alignment of the elevator rope laterally with respect to the sheave.

2. An elevator system according to claim 1, wherein the pair of engagement surfaces comprises a pair of side walls disposed on the guide body in substantially parallel relationship to form a guide slot.

3. An elevator system according to claim 2, wherein the guide body further comprises a generally cylindrical surface having the side walls disposed thereon and extending outwardly therefrom at substantially right angles, the guide body being rotatably mounted on an axis generally parallel to an axis of rotation of the sheave, the guide slot further including the cylindrical surface.

4. An elevator system according to claim 2, wherein the guide slot has a guide slot width that is narrower than a width of a groove on the sheave into which the rope operatively engages.

5. An elevator system according to claim 2, wherein the guide slot is constructed of a low-friction material.

6. An elevator system according to claim 2, further comprising a retainer plate removably mounted over the guide slot to enclose the elevator rope within the guide slot.

7. An elevator system according to claim 1, further comprising a frame for mounting the guide body in general tangential alignment with respect to the elevator sheave.

8. An elevator system according to claim 1, wherein the sheave comprises a substantially constant-radius cylindrical surface operatively engaging the elevator rope, and the guide body provides alignment of the elevator rope with respect to the sheave such that the cylindrical surface of the sheave retains operative engagement with the rope.

9. An elevator system according to claim 1, wherein the elevator rope further comprises a substantially flat elevator rope.

10. An elevator system comprising:

an elevator car engaged with an elevator rope;

an elevator sheave in operative engagement with the elevator rope; and an elevator rope guide device including a guide body in operative engagement with the elevator rope, the guide body including an opposed pair of engagement surfaces adapted to receive the elevator rope therebetween, the engagement surfaces adapted to engage opposing portions of the elevator rope there-against, wherein the pair of engagement surfaces enables the guide body to provide alignment of the elevator rope laterally with respect to the sheave, wherein the pair of engagement surfaces comprises a pair of side walls disposed on the guide body in substantially parallel relationship to form a guide slot, wherein the guide body further comprises a substantially planar surface having the side walls disposed thereon and extending outwardly therefrom at substantially right angles, the guide slot further including the planar surface.

11. An elevator system according to claim 10, wherein the guide slot includes beveled edges formed on the planar surface and the side walls respectively, at opposite ends of the guide slot.

* * * * *